US012247341B2

(12) United States Patent
Yoo

(10) Patent No.: US 12,247,341 B2
(45) Date of Patent: Mar. 11, 2025

(54) WASHING METHOD OF HEADWEAR GARMENT, WASHED HEADWEAR GARMENT USING THE SAME AND ONE-STEP WASHING MACHINE FOR HEADWEAR GARMENT

(71) Applicant: YUPOONG, INC., Seoul (KR)

(72) Inventor: Heungsun Yoo, Gimpo-si (KR)

(73) Assignee: YUPOONG, INC., Seoul (KR)

( * ) Notice: Subject to any disclaimer, the term of this patent is extended or adjusted under 35 U.S.C. 154(b) by 238 days.

(21) Appl. No.: 17/859,180

(22) Filed: Jul. 7, 2022

(65) Prior Publication Data

US 2023/0323587 A1 Oct. 12, 2023

(30) Foreign Application Priority Data

Apr. 7, 2022 (KR) ..... 10-2022-0043518

(51) Int. Cl.

| | |
|---|---|
| ***D06F 35/00*** | (2006.01) |
| ***D06F 23/02*** | (2006.01) |
| ***D06F 25/00*** | (2006.01) |
| ***D06F 39/08*** | (2006.01) |

(52) U.S. Cl.

CPC ..... *D06F 35/005* (2013.01); *D06F 23/02* (2013.01); *D06F 25/00* (2013.01); *D06F 39/088* (2013.01)

(58) Field of Classification Search

CPC ..... D06F 23/02; D06F 25/00; D06F 35/005; D06F 39/088

See application file for complete search history.

(56) References Cited

U.S. PATENT DOCUMENTS

| | | | | |
|---|---|---|---|---|
| 1,843,126 | A * | 2/1932 | Geocares | D06F 43/02 8/142 |
| 1,889,668 | A * | 11/1932 | Kling | A42C 1/08 223/20 |
| 1,889,761 | A * | 12/1932 | Schlesinger | A42C 1/08 34/103 |
| 5,482,064 | A * | 1/1996 | Goddard | B08B 3/006 134/146 |
| 9,957,652 | B1 * | 5/2018 | Fouch | D06F 17/12 |
| 2011/0223376 | A1 * | 9/2011 | Cho | B32B 5/26 428/102 |
| 2013/0074882 | A1 * | 3/2013 | Ackermann | A62B 23/025 134/103.3 |
| 2016/0273152 | A1 * | 9/2016 | Farris | D06F 73/02 |
| 2017/0022650 | A1 * | 1/2017 | King | D06F 17/04 |

FOREIGN PATENT DOCUMENTS

| | | |
|---|---|---|
| KR | 10-1054643 | 8/2011 |
| KR | 10-2011-0128372 | 11/2011 |
| KR | 10-1351015 | 1/2014 |

* cited by examiner

*Primary Examiner* — Joseph L. Perrin

(74) *Attorney, Agent, or Firm* — LEX IP MEISTER, PLLC

(57) ABSTRACT

A headwear garment washing method, a headwear washed with the washing method, a one-step headwear garment washing machine, and a headwear washed by the one-step washing machine are provided.

9 Claims, 9 Drawing Sheets

WASHING METHOD OF HEADWEAR GARMENT, WASHED HEADWEAR GARMENT USING THE SAME AND ONE-STEP WASHING MACHINE FOR HEADWEAR GARMENT

CROSS-REFERENCE TO RELATED APPLICATION

This application claims priority to and the benefit of Korean Patent Application No. 10-2022-0043518 filed in the Korean Intellectual Property Office on Apr. 7, 2022, the entire contents of which are incorporated herein by reference.

BACKGROUND OF THE INVENTION

(a) Field of the Invention

The present invention relates to a headwear garment washing method, a headwear washed using the same washing method, a one-step washing machine for a headwear garment, and a headwear washed using the same washing machine.

(b) Description of the Related Art

When manufacturing headwear, a garment washing process is carried out to produce a natural look of color and a soft texture of the headwear. Here, garment washing includes the post-processing of finished products as well as the washing process.

The purpose of this garment washing is to make ① a feel of softness, ② shrinkage reduction, ③ a vintage effect or a worn-out look, and the like. These effects of the garment washing are highly value-added and it is widely used in the industry as a post-processing method.

Traditionally, the garment washing process roughly consists of the following three steps.

① Wet Process (Washing): Initial step of product-washing in a large washing machine using a large amount of water and chemicals that increase the washing effect (fabric softener, etc.)

② Spin Drying: Products washed as in the previous step, the wet process, are spin dried in a spin dryer.

③ Drying: Last step of hot air drying.

In other words, the garment washing process as above requires copious amounts of water, chemicals, three different machines and electric power necessary to conduct each step, which has been a common way of the headwear garment washing until recently.

However, due to rapidly changing climate environment in recent years, there has been a shift in consumer attitudes toward environmental sustainability and more and more people are purchasing green or environment-friendly products. As ESG-oriented management movements are being accelerated throughout the manufacturing industry, companies are planning to change their existing production system by focusing on the environment-friendly production process.

SUMMARY OF THE INVENTION

The present invention provides a headwear garment washing method and a headwear garment washing machine which are environmentally-friendly and headwear products which are eco-friendly washed using the same method or machine: A one-step garment washing method uses only one machine rather than three or more machines used in the traditional way and reduces water consumption dramatically compared to the conventional way of "headwear garment washing process" while using no chemicals like softeners The washing method and machine of the present invention and the headwear products washed using the same preserve the environment while matching changes in consumer needs.

A headwear garment washing method according to an embodiment of the present invention includes: a first step for putting headwear into a cylinder; a second step to wet both of the inner and outer sides of the headwear by spraying water into the cylinder, while rotating the cylinder; and a third step to dry the wet headwear, wherein the amount of sprayed water is not more than 15 liters per 500 pieces of the headwear.

The water temperature may be above 0° C. and 25° C. or under.

The first step, the second step, and the third step may all be carried out in sequence in one machine.

The cylinder may have a depth of 1100 mm to 1300 mm, and a diameter of the cylinder cross-section may be 1500 mm to 1700 mm.

The water may be sprayed through a spray nozzle, and an angle of the spray nozzle may be 30° to 45°.

The amount of water sprayed through the spray nozzle may be 6 to 7 gallons per hour.

The water may be sprayed through three to five spray nozzles.

A one-step headwear garment washing machine according to another embodiment of the present invention includes: a washing and drying unit that includes a cylinder where headwear is put and a spray device that sprays water into the cylinder; a water tank; a water pump; and an operation panel, wherein the amount of water sprayed from the spray device may be not more than 15 liters per 500 pieces of the headwear.

The temperature of the water, the depth of the cylinder and the diameter of the cylinder cross-section may be the same as described above.

A spray device may include a spray nozzle, and an angle of the spray nozzle may be 30° to 45°.

The amount of water sprayed through the spray nozzle may be 6 to 7 gallons per hour.

Three to five spray devices may be provided.

According to another embodiment of the present invention, a headwear washed by the headwear garment washing method is provided.

According to another embodiment of the present invention, a headwear washed by the one-step headwear garment washing machine is provided.

The headwear garment washing method and washing machine according to the present invention require only a small amount of water without using any chemicals, which can contribute to the protection of the environment by reducing water consumption dramatically while making desired effects of the headwear garment washing, i.e. a feel of softness, shrinkage reduction and a vintage effect or a worn-out look.

In addition, since only one washing machine performs washing, spin drying and drying processes sequentially, power consumption can be minimized, and since the drying process is performed as the last step, zero discharge of wastewater is achieved, which would better protect the environment.

DETAILED DESCRIPTION OF THE EMBODIMENTS

Hereinafter, an embodiment of the present invention will be described in detail. However, this is provided as an example, and the present invention is not limited thereto, and the present invention is only defined by the scope of claims to be described later.

The terminology used in the present invention is only used to describe specific embodiments, and is not intended to limit the present invention. Expressions in the singular include a plurality of expressions unless the context clearly dictates otherwise. In the present application, terms such as "comprise" or "include" are intended to designate the existence of features, numbers, steps, operations, constituent elements, parts, or combinations thereof described in the specification, and it is to be understood that this does not preclude in advance the possibility of the presence or addition of one or more other features or numbers, steps, actions, constituent elements, parts or combinations thereof.

Unless defined otherwise, all terms used herein, including technical or scientific terms, have the same meaning as commonly understood by a person of an ordinary skill in the art to which the present invention belongs. Terms such as those defined in the generally-used dictionary should be interpreted as having a meaning consistent with the context of the related art, and should not be interpreted in an ideal or excessively formal sense unless explicitly defined in the present invention.

Hereinafter, the technical configuration of the present invention will be described in detail with reference to the accompanying drawing and preferred embodiments. However, the present invention is not limited to the embodiment described herein and may be embodied in other forms. Throughout the specification, the same reference number used to describe the present invention indicates the same constituent elements.

According to an embodiment, a headwear garment washing method includes: a first step to put a headwear in a cylinder; a second step to wet both of the outer and inner sides of the headwear with water spraying into the cylinder spinning; and a third step to dry the wet headwear, wherein the amount of sprayed water is not more than 15 liters per 500 pieces of the headwear.

The major drawback of the existing headwear garment washing method is that it consumes copious amounts of water to wash only a small quantity of headwear. Specifically, according to a research, 560 liters of water is consumed at the first step of chemical treatment for 70 kg of garments and further 420 liters of water is consumed at the second step of softening. (Effective Mechanical and Chemical Washing Process in Garment Industries. American Journal of Applied Physics. 2, 1-25 (2017)) Total 980 liters of water is consumed in the washing process for 70 kg of garments.

Figure 1:
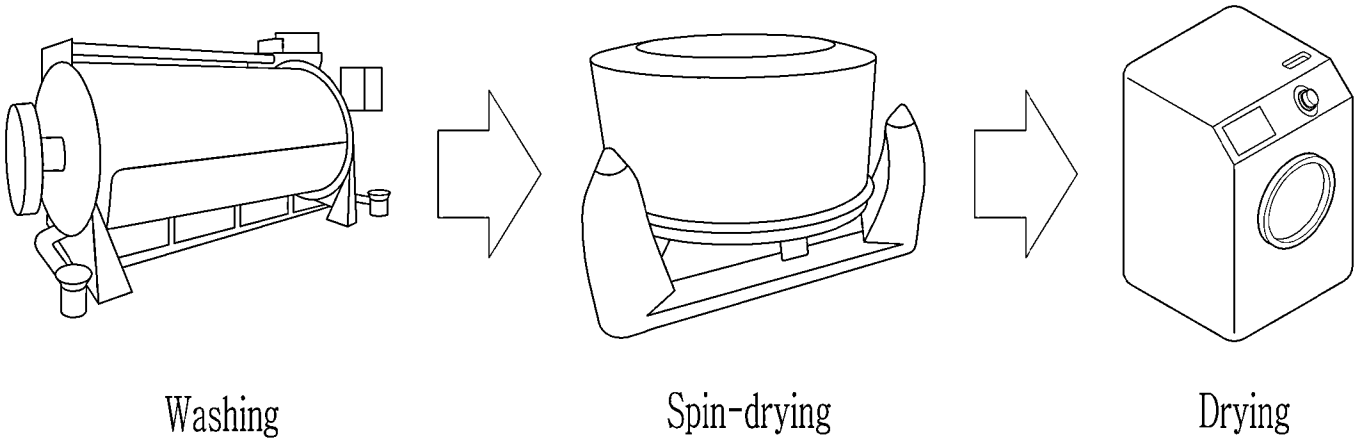
FIG. 1 shows a flowchart and photographs of machines for the washing process currently used in the industry.

The conventional way of headwear garment washing uses more than 500 liters of water per 500 pieces of headwear, which means the actual washing process requires high levels of water, i.e. 1 liter of water per piece of headwear. Since the conventional method uses chemicals, the water used in the process cannot be recycled. (FIG. 1 shows the washing process currently used in the industry: The washing process is comprised of three steps, washing, spin-drying, and drying, and it requires a large amount of water, energy, and chemicals. In the existing method of the washing process, chemicals are used for fabric treatment which are then removed by a water-washing process, and softening agent treatment is followed to improve hand feel. The washing process is substantially divided into more than three steps after all, at each step of which a significant amount of water and chemicals are used.)

Thus, the inventor of the present invention began research on a washing method that could achieve excellent washing quality without using chemicals while innovatively reducing the copious amount of water used according to the conventional method. The research once was in jeopardy owing to the research and development costs further increased by so many failures and trials and errors. Through a great deal of effort, however, a very innovative method of headwear garment washing is developed, which i) contributes to the protection of the environment by reducing water consumption dramatically; ii) achieves, without using any chemicals, the equal level of washing quality or higher compared to the conventional washing method; iii) minimizes power consumption by using only one washing machine; and iv) generates no wastewater after the washing process is completed.

Specifically, in the second step, water is sprayed on the outer and inner surfaces of the headwear (just like spraying water on the face with a mist), and a small amount of water, specifically 15 liters or less of water per 500 pieces of headwear, is sufficient to make a washing effect, which has been verified through experiments as described below. It was demonstrated to be sufficient for a desired washing effect if water is sprayed until the outer and inner surfaces of the headwear are wet. Also demonstrated is the shape of where headwear pieces are put: during the tests with several different shapes, a washing effect was achieved effectively with a little amount of water when it was a cylinder, which was followed by the optimized size of a cylinder, its depth and the diameter of the cylinder cross-section. Countless tests followed about water temperature, how water is sprayed at what angle, etc., and finally the method of headwear garment washing was optimized to make a desired washing effect with a small amount of water, specifically, 15 liters or less of water per 500 pieces of headwear (e.g., 14 liters to 15 liters of water per 500 pieces of headwear).

For example, when the amount of water exceeding 15 liters is used to wash 500 pieces of headwear, there is no significant quality difference in terms of washing effect compared to the washing method according to one embodiment, but the drying time increased with more water used, which leads to more energy wasted. The washing method according to one embodiment was proved to be effective with a small amount of water, that is, 15 liters or less of water per 500 pieces of headwear, which the inventor believes to prevent unnecessary waste of water still achieving a washing effect equal to or higher than that of the prior art.

In other words, the washing method according to one embodiment requires only 3% of water compared to the case of using the conventional washing method, which is highly innovative from an eco-friendly perspective by reducing the water consumption by 97% and discharging no wastewater.

For example, the water is at room temperature: the water temperature may be above 0° C. and 25° C. or below, or a temperature of 5° C. to 25° C., or a temperature of 10° C. to 25° C., or a temperature around 15° C.

According to the conventional method of garment washing process, it is necessary to use fabric softeners and other chemicals that can enhance the garment washing effect, and the water temperature should be 40° C. to 60° C. However, the washing method according to the embodiment requires only water at room temperature—neither cooled below 0° C. nor heated above 25° C.—with no use of any chemicals, which means that the temperature condition of water does not require either cooling or heating.

Although the temperature range of room temperature may vary slightly depending on the natural climatic environment, it is important to note that the present invention according to one embodiment achieves the headwear garment washing effect equal to or higher than that of the conventional method with a small amount of water neither heated nor cooled using artificial energy. There is a merit of minimizing the power consumption in that it is not necessary to heat or cool water. (e.g., when the water at room temperature is measured to be 15° C. and the conventional method of the garment washing requires the water temperature of 50° C., the conventional method requires about 17,500 kcal to heat the water necessary to conduct the garment washing for 500 pieces of headwear, while the washing method according to one embodiment does not require heated water and therefore saves electric power that otherwise would have been lost as heat energy.)

For example, all three steps, from the first to the third, can be conducted sequentially in one machine contrary to the conventional method as shown in FIG. 1 according to which the washing, spin-drying, and drying processes are each carried out in different machines. In the present invention, all of the washing, spin-drying, and drying steps of the washing process are carried out in one machine such that the washing process can be performed in one step. Accordingly, the amount of water used can be dramatically reduced, while allowing minimization of power consumption.

For example, a cylinder may have a depth of 1100 mm to 1300 mm, and a diameter of the cylinder cross-section may be 1500 mm to 1700 mm. Most of the conventional washing machines or dryers have a cylinder inside, of which depth and cross-section diameter is 1400 mm, respectively. The 1400 mm (cylinder depth)*1400 mm (cylinder cross-section diameter) standard is actually widely used.

Figure 7:
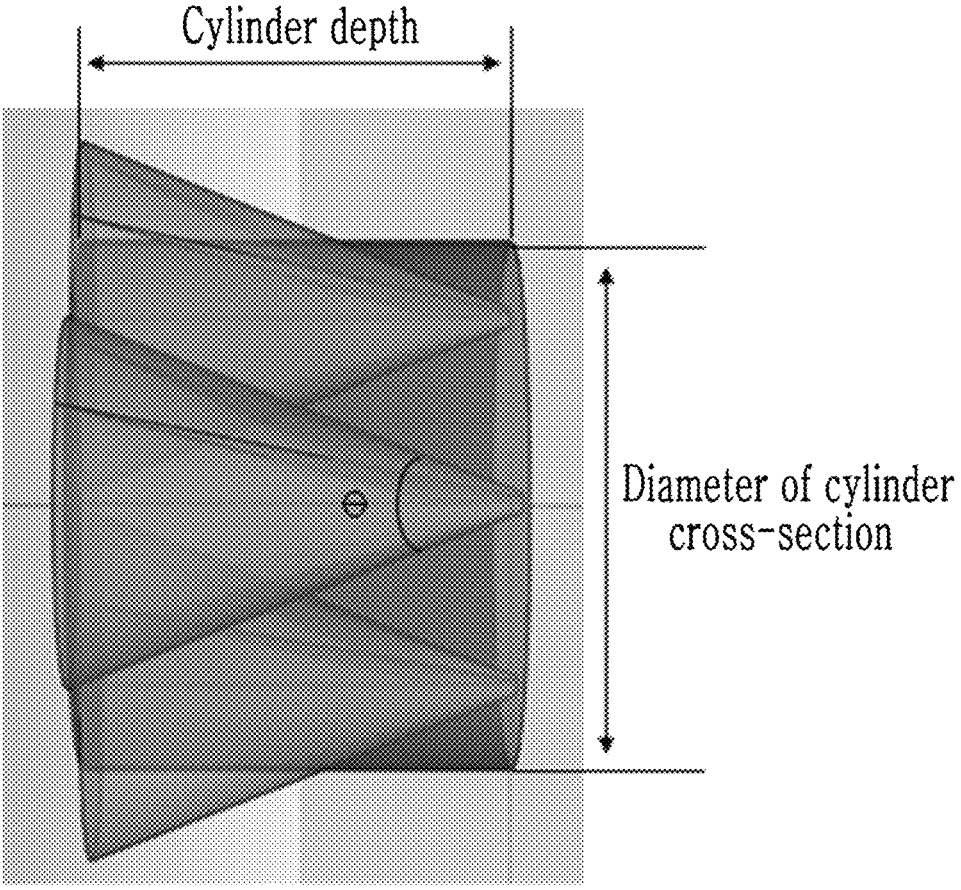
FIG. 7 shows a depth of a cylinder that forms the washing machine of FIG. 4, a diameter of the cross-section of the cylinder, and water spraying through a spray nozzle in the cylinder.
Figure 8:
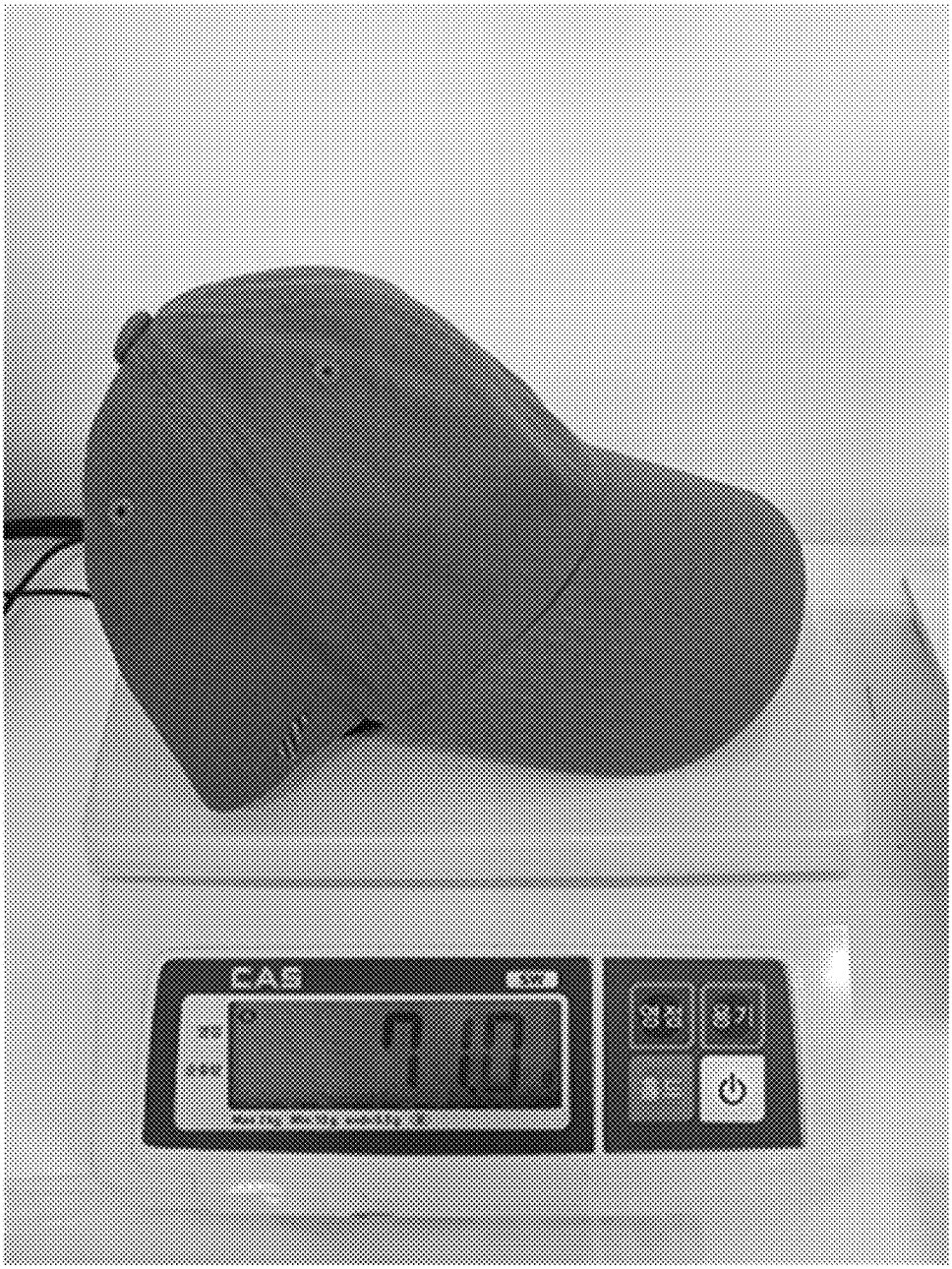
FIG. 8 is a photograph that shows a headwear being weighed before the washing process according to the conventional washing method referred to in the present invention.
Figure 9:
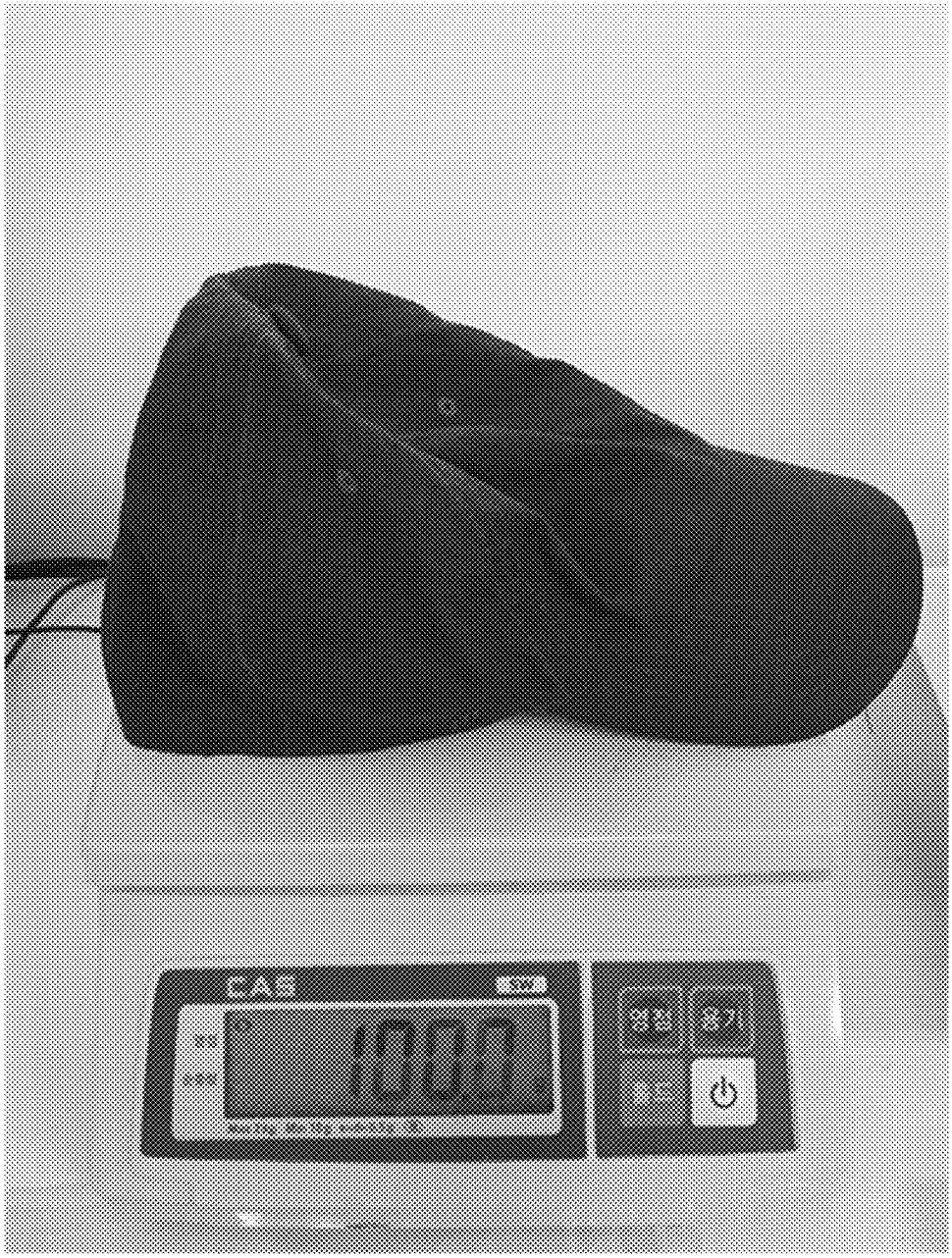
FIG. 9 is a photograph that shows a headwear being weighed after the washing and spin drying steps (before the drying step) according to the conventional washing method referred to in the present invention.

However, the 1400 mm*1400 mm standard (conventional standard) may not be suitable for the washing method according to the embodiment. As described above, since a small amount of water rather than an excessive amount is used in the washing method according to an embodiment, being sprayed on the outer and inner surfaces of the headwear like mist until both surfaces are evenly wet, the depth of the cylinder must be shallower and the diameter of the cylinder cross-section must be longer than the 1400 mm*1400 mm standard. Therefore, the washing method according to the embodiment requires that the cylinder have a depth of 1100 mm to 1300 mm, which is about 200 mm shallower than the conventional standard, and the diameter of the cylinder cross-section of 1500 mm to 1700 mm, which is about 200 mm longer than the conventional standard. For example, the cylinder may have a depth of about 1200 mm and the diameter of the cylinder cross-section may be about 1600 mm. (Refer to FIG. 7)

Figure 2:
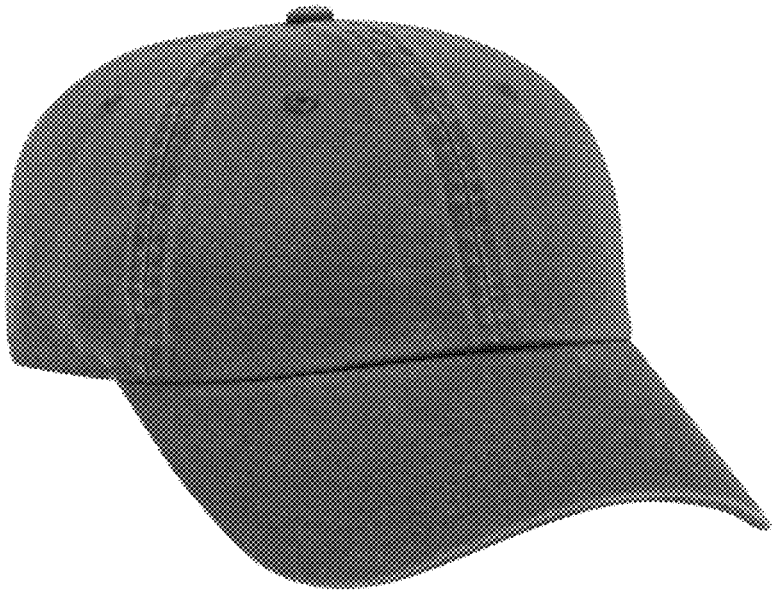
FIG. 2 is a photograph of a headwear garment washed by the conventional washing method.
Figure 3:
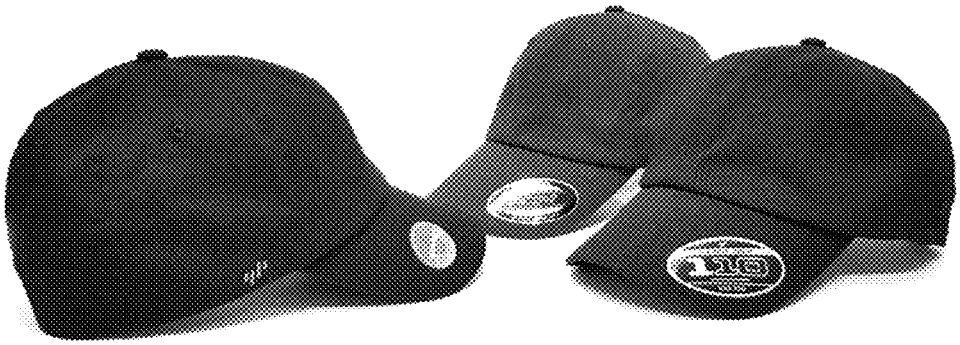
FIG. 3 is a photograph of a headwear garment washed by a washing method according to an embodiment of the present invention.

Compared to the conventional washing method consuming a large amount of water, the washing method according to the embodiment using a small amount of water may have an insufficient washing effect. However, the washing method according to an embodiment is expected to make a natural washing effect that occurs when headwear pieces fall from a higher place (keeping the diameter of the cylinder cross-section longer) by controlling the depth of the cylinder and the diameter of the cylinder cross-section as described above. Accordingly, the washing method according to the embodiment can sufficiently produce a washing effect equal to or higher than that of the prior art. (Referring to FIG. 2 and FIG. 3, it can be proved that both the headwear garment washed with the conventional washing method and the headwear garment washed with the washing method according to the embodiment have the same level of washing quality.)

In addition, the water can be sprayed through a spray nozzle, and when an angle θ of the spray nozzle is 45° or less, for example 30° to 45°, and the depth of the cylinder and the diameter of the cross-section of the cylinder are within the range as above, it may be most suitable to sufficiently wet the entire headwear inside the cylinder with water. When the angle of the spray nozzle exceeds 45°, it may be difficult to spray water evenly on the outer and inner surfaces of the headwear pieces placed at the bottom of the cylinder with a depth of about 1200 mm. (Refer to FIG. 7)

For example, the amount of water sprayed through the nozzle can be 6 to 7 gallons per hour.

Figure 5:
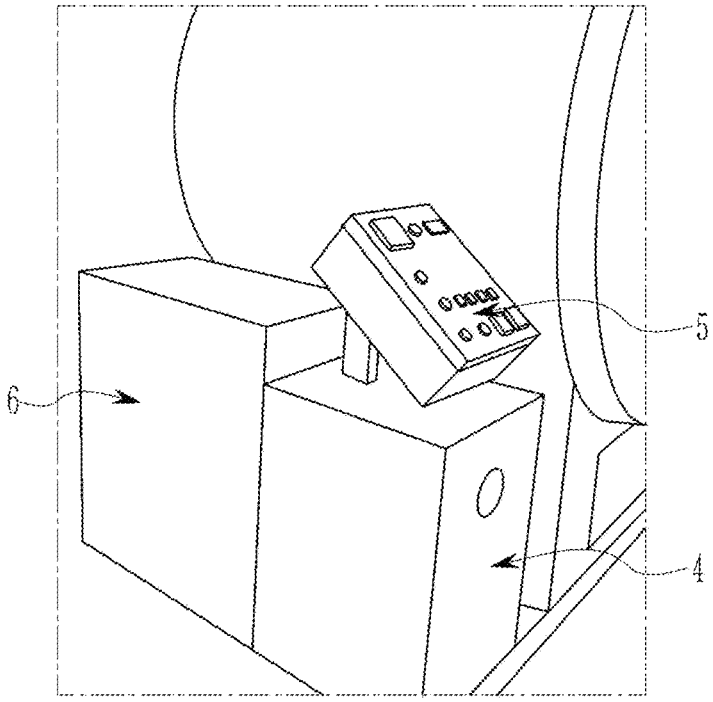
Figure 6:
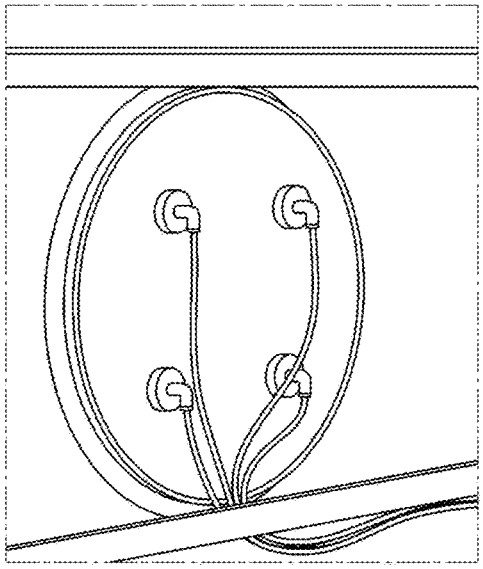
FIG. 6 shows a spray device of the washing machine of FIG. 4.

For example, the water can be sprayed through three to five nozzles, for example, four spray nozzles (refer to FIG. 5).

For example, it may efficiently produce a washing effect by controlling, as described above, the amount of water sprayed through the nozzles, the number of which nozzles may be three to five, for example four spray nozzles.

Figure 4:
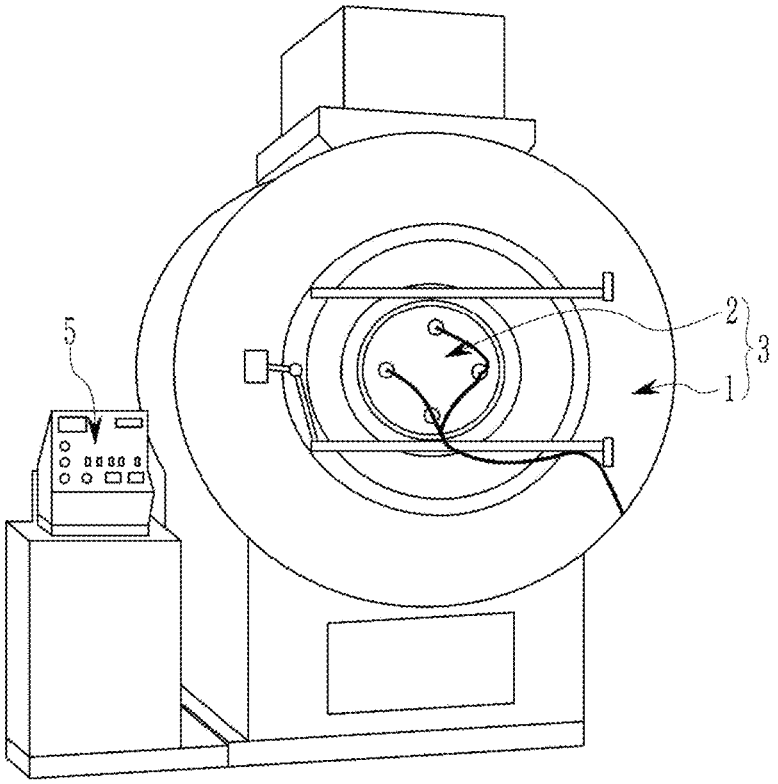
FIG. 4 and FIG. 5 are figures each showing a washing machine according to an embodiment of the present invention.

According to another embodiment, a one-step headwear garment washing machine can be provided, which includes a washing unit 3 having a cylinder 1 in which headwear pieces are put and a spraying device 2 that sprays water inside the cylinder 1; a water tank 6; a water pump 4; and an operation panel 5. An amount of water sprayed from the spraying device 2 is less than 15 liters per 500 pieces of the headwear. (Refer to FIG. 4)

As described above, the headwear garment washing method according to the embodiment is an environmentally friendly way that dramatically reduces the water consumption required by the conventional method still maintaining the level of washing quality equal to or higher than that of the prior art by replacing the washing and spin-drying processes in the conventional garment washing method with the spray-on water technique, that is, by spraying a small amount of water evenly on the outside and inside of the headwear garment similarly to the conventional spin-drying process after washing such that the above conventional two processes (washing and spin-drying) are replaced with one process).

The present invention was proceeded with to develop a machine to implement the washing method according to the embodiment for a mass production factory, and as a result, a one-step headwear garment washing machine was developed as described above.

The cylinder and the spray device forming the one-step headwear garment washing machine may be the same as described above.

The water tank may store the water to be sprayed through the spray nozzle in the spray device, and the water pump helps to constantly spray water into the cylinder at a desired time, pressure and the like, which can be controlled by a machine or manually through an operation panel.

The description of each of the components forming the one-step headwear garment washing machine may be the same as stated above.

Another embodiment provides headwear washed by the headwear garment washing method.

Another embodiment provides headwear washed in the one-step headwear garment washing machine.

Hereinafter, a preferred embodiment of the present invention will be described. However, the following embodiment is only an embodiment of the present invention, and the present invention is not limited to the following embodiment.

<Calculation of the Weight of Water Per Headwear Piece Required for Washing>

By using the conventional washing method, the weight of one piece of headwear was measured three times: first, before starting the whole washing process secondly, after the washing and spin-drying steps, and lastly, after the drying step, the results of which are shown in Table 1 below.

TABLE 1

(unit: g)

| | Before washing | After washing and spin-drying (before drying) | After drying |
|---|---|---|---|
| Weight | 71 | 100 | 71 |

Referring to Table 1, the weight increase of about 30 g per piece of headwear is observed, which means about 15 liters of water is required to conduct the washing process for 500 pieces of headwear. In other words, it can be observed that only about 15 liters of water per 500 pieces of headwear can produce a sufficient washing effect.

<Evaluation of Washing Effect Depending on the Amount of Water Used>

Washing effect was evaluated by using 10 liters, 15 liters, and 20 liters of water per 500 pieces of headwear, respectively. Specifically, 500 pieces of headwear were put into a cylinder of the 1200 mm (cylinder depth)*1600 mm (diameter of cylinder cross-section) size. While the cylinder was spinning, water was sprayed at an angle of 45° through four spray devices each containing a spray nozzle inside the cylinder until both of the outer and inner surfaces of the headwear were wet and then the drying step was conducted for the wet pieces of headwear, of which time until complete drying was measured. After that, a washing effect was evaluated for the 500 pieces of headwear in terms of the hand feel and the level of shrinkage, and the results are shown in Table 2 to Table 4 below. The level of shrinkage was evaluated visually and the hand feel was evaluated by touching: five people scored the shrinkage level by seam puckering and the hand feel by the feel of softness (1 point: Very Poor/2 points: Poor/3 points: Fair/4 points: Good/5 points: Excellent) and the average was calculated.

TABLE 2

(unit: point)

| Amount of Water Used | Feel of Softness |
|---|---|
| 10 liters | 3 |
| 15 liters | 5 |
| 20 liters | 5 |

TABLE 3

(unit: point)

| Amount of Water Used | Level of Shrinkage |
|---|---|
| 10 liters | 5 |
| 15 liters | 5 |
| 20 liters | 5 |

TABLE 4

(unit: point)

| Amount of Water Used | Drying Time (productivity) |
|---|---|
| 10 liters | 5 |
| 15 liters | 4 |
| 20 liters | 3 |

Referring to Table 2 to Table 4, a sufficient washing effect can be achieved by using only 15 liters of water per 500 pieces of headwear, and it was proved that there is no significant quality difference in terms of washing effect when the amount of water exceeding 15 liters is used, but only the drying time increased with more water used, which leads to unnecessary energy wasted.

DESCRIPTION OF SYMBOLS

1 cylinder
2 spray device that sprays water inside cylinder
3 washing part
4 water pump
5 operation panel
6 water tank
8 angle of spray nozzle

What is claimed is:

1. A headwear garment washing method using a one-step headwear garment washing machine comprising:

a washing and drying unit that includes a cylinder where headwear is put and a spray device that sprays water into the cylinder;

a water tank storing the water in a temperature of above 0° C. and 25° C. or below;

a water pump supplying the water to the spray device; and an operation panel, wherein the spray device comprises a spray nozzle spraying the water in a spray angle of 30° to 45° with respect to a spraying center axis of the spray nozzle, wherein the spraying center axis of the spray nozzle is parallel to an axis of the cylinder, the method comprising:

a first step for putting headwear into the cylinder;

a second step during which inner and outer sides of the headwear both are wetted by spraying water into the cylinder with the spray device, while rotating the cylinder; and a third step for drying the wet headwear, wherein an amount of water sprayed with the spray device is 15 liters or less per 500 pieces of the headwear.

2. The headwear garment washing method of claim 1, wherein the first step, the second step, and the third step are all executed sequentially in one machine.

3. The headwear garment washing method of claim 1, wherein the cylinder has a depth of 1100 mm to 1300 mm, and a diameter of the cylinder cross-section is 1500 mm to 1700 mm.

4. The headwear garment washing method of claim 1, wherein the amount of water sprayed through the spray nozzle is 6 to 7 gallons per hour.

5. The headwear garment washing method of claim 1, wherein the water is sprayed through three to five spray nozzles.

6. A one-step headwear garment washing machine comprising:

a washing and drying unit that includes a cylinder where headwear is put and a spray device that sprays water into the cylinder;

a water tank storing the water in a temperature of above 0° C. and 25° C. or below;

a water pump supplying the water to the spray device; and an operation panel, wherein the spray device comprises a spray nozzle spraying the water in a spray angle of 30° to 45° with respect to a spraying center axis of the spray nozzle, wherein the spraying center axis of the spray nozzle is parallel to an axis of the cylinder, wherein an amount of water sprayed from the spray device is 15 liters or less per 500 pieces of the headwear.

7. The one-step headwear garment washing machine of claim 6, wherein the cylinder has a depth of 1100 mm to 1300 mm, and a diameter of the cylinder cross-section is 1500 mm to 1700 mm.

8. The one-step headwear garment washing machine of claim 6, wherein the spray device sprays the water in an amount of 6 to 7 gallons per hour.

9. The one-step headwear garment washing machine of claim 6, wherein the spray device comprises 3 to 5 spray nozzles.

* * * * *